US006322388B1

(12) United States Patent
Akio et al.

(10) Patent No.: US 6,322,388 B1
(45) Date of Patent: Nov. 27, 2001

(54) ELECTRICAL CONNECTOR

(75) Inventors: Yamada Akio; Kouda Takaharu, both of Tokyo; Hayakawa Manabu, Kariya, all of (JP)

(73) Assignees: DDK Ltd.; Densco Corp., both of (JP)

( * ) Notice: Subject to any disclaimer, the term of this patent is extended or adjusted under 35 U.S.C. 154(b) by 0 days.

(21) Appl. No.: 09/579,032

(22) Filed: May 26, 2000

(30) Foreign Application Priority Data

May 27, 1999 (JP) ..... 11-147617
Oct. 18, 1999 (JP) ..... 11-295307

(51) Int. Cl.[7] ..... H01R 13/58
(52) U.S. Cl. ..... 439/459; 439/492
(58) Field of Search ..... 439/459, 456, 439/458, 460, 463, 499, 492, 701, 404, 405, 417

(56) References Cited

U.S. PATENT DOCUMENTS 4,006,957 * 2/1977 Narozny ..... 339/103
5,401,186 * 3/1995 Nozaki et al. ..... 439/495
6,036,531 * 3/2000 Lee et al. ..... 439/459
6,132,241 * 10/2000 Hwang ..... 439/459

* cited by examiner

*Primary Examiner*—Gary Paumen
*Assistant Examiner*—Alexander Gilman
(74) *Attorney, Agent, or Firm*—Baker Botts LLP

(57) ABSTRACT

An electrical connector includes a pin connector and a cable connector detachably fitted with each other. The cable connector includes a cable, socket contacts to be connected to conductors of the cable, a housing for holding and fixing the socket contacts therein, a cover mounted onto the housing to cover it and urging the cable against the socket contacts, and a strain-relief mounted onto the housing to cover the cover and embracing the cable with the cover therebetween. The pin connector includes pin contacts to be fitted with the socket contacts, and a block for holding and fixing the pin contacts therein. The strain-relief consists of a main body and side portions. The main body has an upper surface lower than upper surfaces of the side portions substantially by the thickness of the cable, and the upper surfaces of the side portions are substantially flush with the upper surface of the cover when the strain-relief has been mounted on the housing.

5 Claims, 8 Drawing Sheets

ELECTRICAL CONNECTOR

BACKGROUND OF THE INVENTION

This invention relates to an electrical connector used in an electric appliance and having a pin connector and a cable connector fitted with each other, and more particularly to an electrical connector effectively reduced in height.

A hitherto used electrical connector will be explained by referring to FIG. 5 showing a cable connector 94 in perspective view and FIG. 6 illustrating a socket connector 12 with a cable 18 and a cover 16 and a conventional strain-relief 92. The cable connector 94 is detachably fitted with a pin connector 30 (refer to FIG. 1) to form the electrical connector. As shown in FIG. 5, the cable connector 94 includes the strain-relief 92, the cable 18, the cover 16, and the socket connector 12 including socket contacts 68 held and fixed in a housing 14 (refer to FIG. 4).

As shown in FIG. 6, the cable 18 is bent 180 degrees or folded onto the cover 16 and the strain-relief 92 is then mounted in the direction shown by an arrow D onto the cable 18 to fix the cable 18 to the cover 18. Such a fixation of the cable 18 by the strain-relief 92 serves to prevent the piercing connection between conductors of the cable 18 and U-shaped slits 70 of the socket contacts 68 (refer to FIG. 4) from being subjected to forces when, for whatever reason, the cable 18 is twisted. The conventional cable connector shown in FIG. 5 has a height (H) of the order of 19.6 mm.

As described above, in order to avoid the stress concentration at the piercing connections of the socket contacts 68 of the cable connector 94, the cable 18 is folded 180 degrees onto the cover 16 and the strain-relief 92 is mounted thereon to rigidly fix the cable 18, so that the thus assembled cable connector could not comply with the imposed requirement for the reduction in height of an electrical connector which is effective to install it in a narrower space in an electric appliance. In the exemplary cable connector 94 shown in FIG. 5, the height (H) could not be less than 18 mm. Moreover, after the cable connector has been once fitted with the pin connector, it is almost impossible to remove the cable connector from the pin connector by means of fingers or even a jig, owing to the narrow space in which the connector has been located in an electrical appliance.

SUMMARY OF THE INVENTION

It is an object of the invention to provide an improved electrical connector capable of preventing piercing connection portions of socket contacts in a cable connector from being subjected to forces caused by a cable when being twisted and can comply with the imposed requirement for reduction in height of the cable connector.

It is another object of the invention to provide an electrical connector whose cable connector can be easily removed from the pin connector by means of a simple tool in a narrow space in an electric appliance in which the electrical connector is installed.

In order to accomplish the objects of the invention, in an electrical connector including a pin connector and a cable connector detachably fitted with each other, said cable connector being composed of a cable, socket contacts to be connected to conductors of said cable, a housing for holding and fixing said socket contacts therein, a cover mounted onto said housing to cover it and urging said cable against said socket contacts, and a strain-relief mounted onto said housing to cover said cover and embracing said cable with said cover therebetween, and said pin connector being composed of pin contacts to be fitted with said socket contacts, and a block for holding and fixing said pin contacts therein, according to the invention said strain-relief consists of a main body and side portions located at both the ends of said main body, and further said main body of the strain-relief has an upper surface substantially lower than upper surfaces of said side portions by the thickness of said cable, and the upper surfaces of said side portions are substantially flush with the upper surface of said cover when the strain-relief has been mounted on said housing. In practice, "substantially flush with" is the state that the upper surfaces of the side portions are lower than the upper surface of the cover by a value of the order of 0 to 0.5 mm.

In a preferred embodiment of the invention, each of the side portions of the strain-relief has a substantially L-shaped cross-section and is formed with a slit extending therethrough in its height direction in the proximity where the side portion is connected to the main body and is further formed with a groove extending therethrough away from the slit in the lengthwise direction of the side portion, thereby providing elasticity to the side portions of the strain-relief in the horizontal and vertical directions. Such an elasticity in the horizontal and vertical directions facilitates to mount the strain-relief onto the socket connector.

In another embodiment of the invention, there are provided spaces between the strain-relief of the cable connector and the block of the pin connector and there is provided removing means made of a plate piece by bending it into a U-shape, whose engaging portions are engageable with the spaces, respectively, thereby enabling the cable connector to be removed.

Preferably, each of the side portions of the strain-relief is provided with a projection extending downwardly to form a protrusion tapered downwardly, forming a space with a part of the side surface of the cover for receiving a string for removing the cable connector, and each of the side portions is provided at its free end with an L-shaped extension adapted to engage a shoulder provided on the cover. With this arrangement, the cable connector is readily removed by the use of the string and the strain-relief is securely prevented from being removed away from the remaining parts of the cable connector in removing the whole cable connector from an electric appliance.

In a further embodiment of the invention, there is provided a removing lever pivotally connected to side surfaces of the strain-relief so as to be rotatable between substantially horizontal and vertical positions about pins provided on the side surfaces. This construction makes it possible to remove the cable connector installed in a narrower space in an electric appliance.

The subject features of the invention described above bring about the following significant effects.

(1) As the need for folding a cable onto the cover of a cable connector is eliminated according to the invention, the height of the cable connector becomes less than 18 mm, thereby enabling the height to be remarkably less than those of the prior art.

(2) The electrical connector according to the invention has a construction to prevent the U-shaped slits of the socket contacts from being subjected to forces when the cable is unintentionally twisted, notwithstanding the elimination of the construction folding a cable onto the cover of a cable connector.

(3) According to the invention, the main body of the strain-relief has an upper surface substantially lower than upper surfaces of the side portions of the strain-relief by the thickness of the cable, and the upper surfaces of the side portions are substantially flush with the upper surface of the cover when the strain-relief has been mounted on the housing. With this construction, the height of the cable connector becomes as little as 14.2 mm which is 5.4 mm less than those of the prior art cable connector.

(4) According to the invention, each of the side portions of the strain-relief has a substantially L-shaped cross-section and is formed with a slit extending therethrough in its height direction in the proximity where the side portion is connected to the main body and is further formed with a groove extending therethrough away from the slit in the lengthwise direction of the side portion. With such a construction, the strain-relief can be easily mounted onto the housing of the cable connector with the aid of the elasticity provided by the slits and grooves.

(5) According to the invention, the cable connector can be easily removed from the pin connector fitted therewith forming the electrical connector by means of a removing jig even if the electrical connector has been installed in a narrow space of an electric appliance.

(6) According to the invention, the cable connector can be readily removed in a simple manner from the pin connector by means of a string, instead of the removing jig, extending around each of the side portions of the strain-relief.

(7) According to the invention, each of the side portions of the strain-relief is provided with a projection extending downwardly to form a protrusion tapered downwardly. With this arrangement, strings are readily inserted below the downwardly tapered protrusion and is prevented from coming out of the protrusion when the string is pulled for removing the cable connector.

(8) Each of the side portions of the strain-relief has a free end provided with an L-shaped extension adapted to engage a shoulder provided on the cover. This arrangement prevents the strain-relief from being deformed outwardly and makes it easy to remove the cable connector from the narrow space in an electric appliance.

(9) According to the invention, there is provided a removing lever pivotally connected to the strain-relief so as to be rotatable between substantially horizontal and vertical positions. Such a pivotal removing lever makes it easy to remove the cable connector from an extremely narrower space in an electric appliance.

The invention will be more fully understood by referring to the following detailed specification and claims taken in connection with the appended drawings.

DESCRIPTION OF THE PREFERRED EMBODIMENTS

Figure 1:
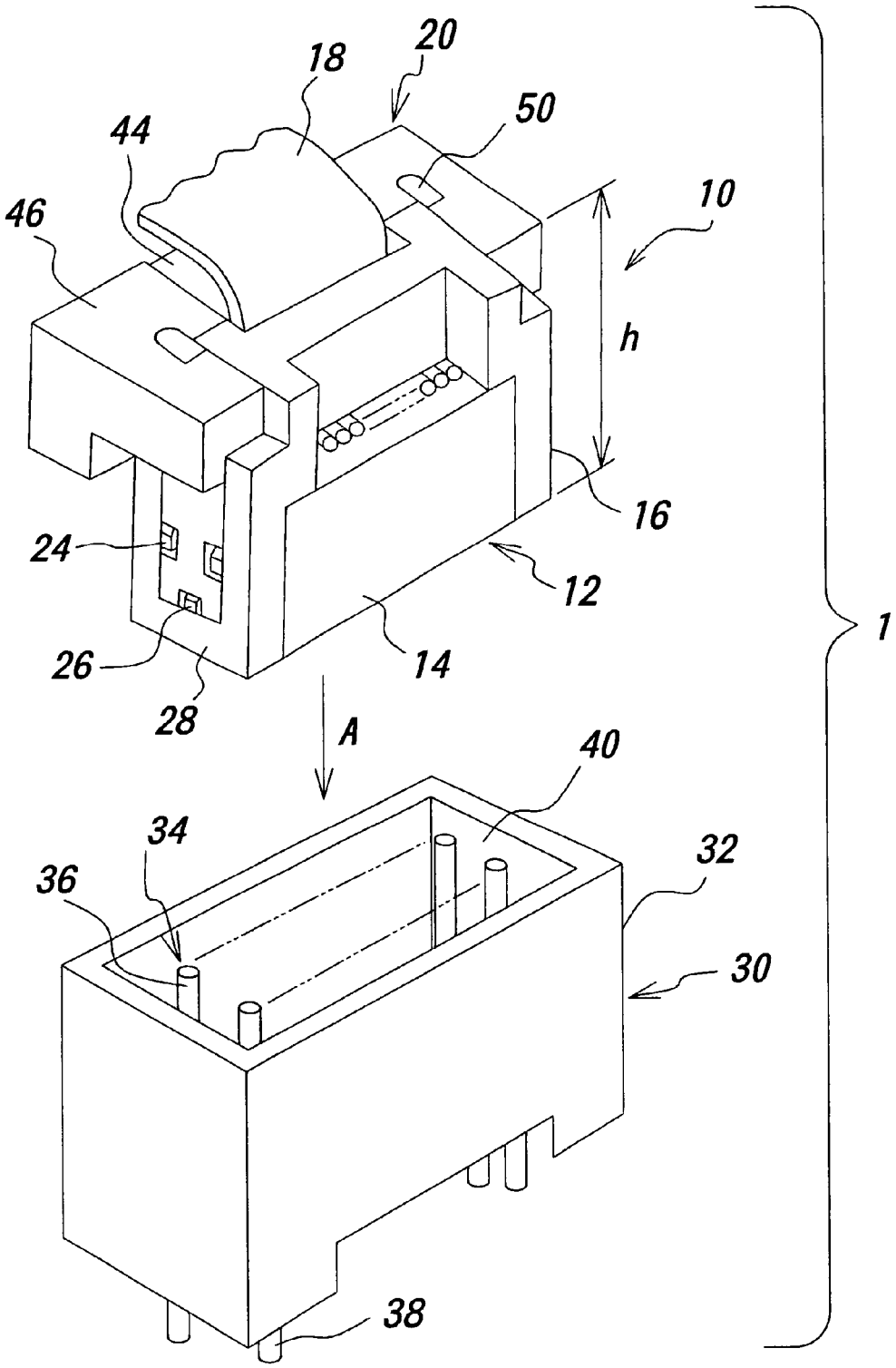
FIG. 1 is a perspective view of an electrical connector including a cable connector and a pin connector according to the invention.

An electrical connector according to one preferred embodiment of the invention will be explained by referring to FIG. 1 to 4. As shown in FIG. 1, the electrical connector 1 comprises a pin connector 30 and a cable connector 10 which are adapted to be detachably fitted with each other in a conventional manner.

The cable connector 10 according to the invention is mainly composed of a socket connector 12 having a housing 14 including socket contacts 68 held and fixed therein (FIG. 4), a cover 16, a strain-relief 20, and a cable 18. The pin connector 30 is composed of pin contacts 34 and a block 32. The respective components will be explained in detail hereinbelow.

Figure 2:
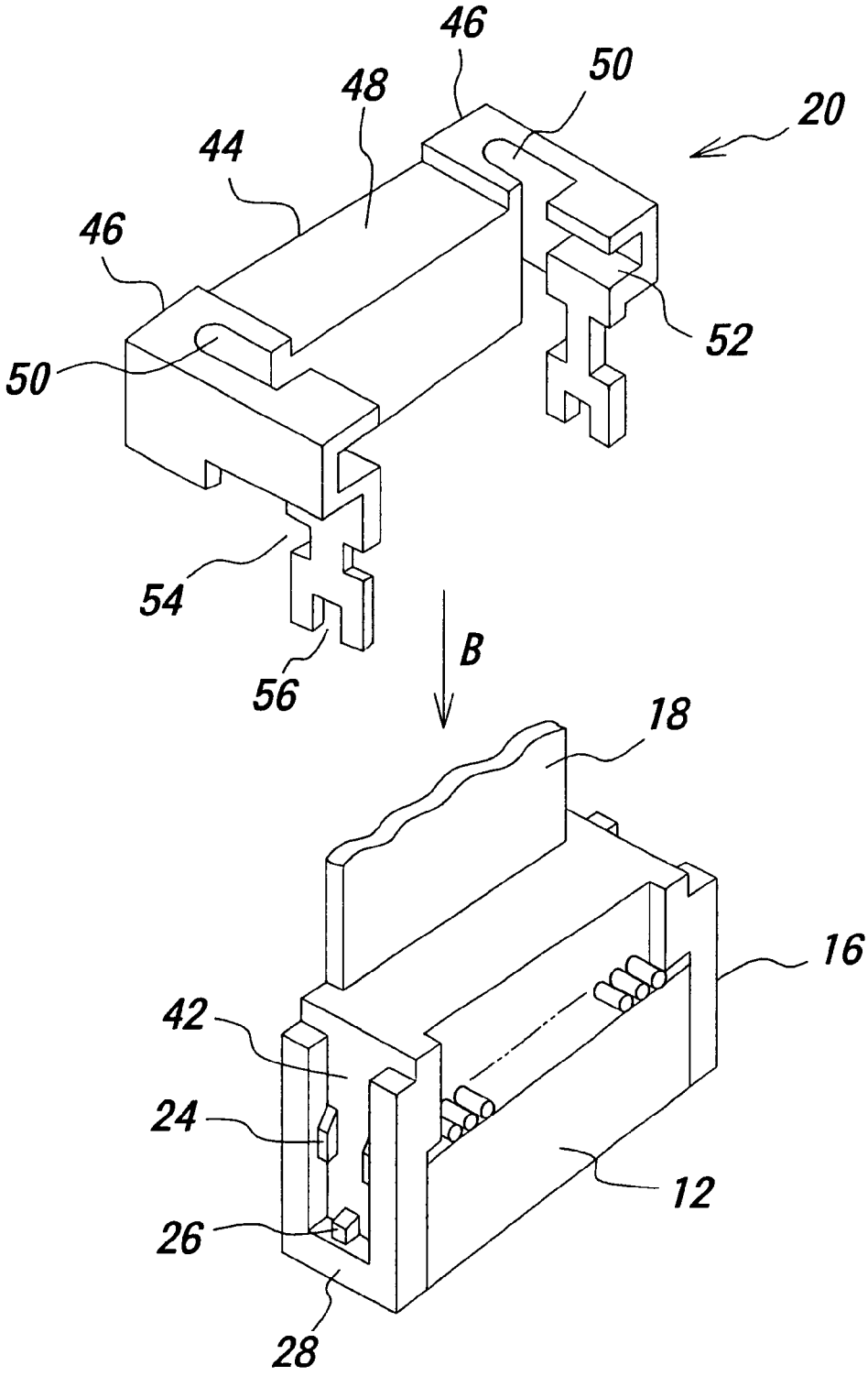
FIG. 2 is a perspective view of the socket connector having a cable and a cover mounted thereon and a strain-relief according to the invention.

First, the strain-relief 20 will be explained, which is a subject matter of the invention. The strain-relief 20 is made of an insulating plastic material by means of the known injection molding. Preferred materials from which to make the strain-relief 20 include polybutylene terephthalate (PBT), polyamide (PA), polycarbonate (PC) and the like which substantially comply with the imposed requirements for the springiness, relatively high strength and low cost. The strain-relief 20 consists of a main body 44 and side portions 46 having an L-shaped cross-section positioned at both the ends of the main body 44, respectively as shown in FIG. 2. The upper surface of the main body 44 is substantially lower than the upper surfaces of the side portions 46 by the thickness of the cable 18. In actually, the difference in height between these upper surfaces may be 0.2 to 0.5 mm more than the thickness of the cable 18.

Each of the side portions 46 is formed with a slit 50 extending through it in its height or vertical direction viewed in FIG. 2 in the proximity of its connected portion to the main body 44. Such slits 50 give an elasticity to the side portions 46 in the horizontal direction or direction toward and away from the main body 44. These slits 50 may have any shape so long as they can give the elasticity to the side portions. In the shown embodiment, the slits have a U-shaped cross-section in order to facilitate the cutting operation and to prevent the strength of the side portions 46 from being reduced. The size of the slits 50 is designed in consideration of the elasticity in the horizontal direction and the strength and workability.

Moreover, each of the side portions 46 is formed adjacent the slit 50 with a groove 52 extending through it away from the slit 50 in the lengthwise direction of the side portion 46. Such grooves 52 give an elasticity to the side portions 46 in the height or vertical direction as viewed in FIG. 2. These grooves 52 may have any shape so long as they can provide the elasticity. In the shown embodiment, the grooves 52 have a U-shaped cross-section in order to facilitate the cutting operation and to prevent their strength from being reduced. The size of the grooves 52 is designed in consideration of the elasticity in the height direction and the strength and workability.

Each of the side portions 46 is further formed with an extension extending downwardly from the lower wall of the groove 52. The extension is formed with engaging portions 54 adapted to engage anchoring portions 24 of the housing 14 and further formed with an escape or a notch 56 at the lower distal end of the extension to avoid the distal end from contacting a latch 26 of the housing 14. The engaging portions 54 may have any shape and size so long as they can engage the anchoring portions 24 of the housing 14 so that they are designed in consideration of their strength, workability and the like. The notches 56 may have also any shape and size so long as they do not contact the latches 26 of the housing 14 so that they are designed in consideration of their strength, workability and the like. In the shown embodiment, the engaging portions 54 and the notches 56 are formed in the U-shapes which may be easily machined. As an alternative, the engaging portions 54 may be formed into a tapered shape corresponding to that of the anchoring portions 24 of the housing, thereby more facilitating the engagement therebetween.

Figure 3:
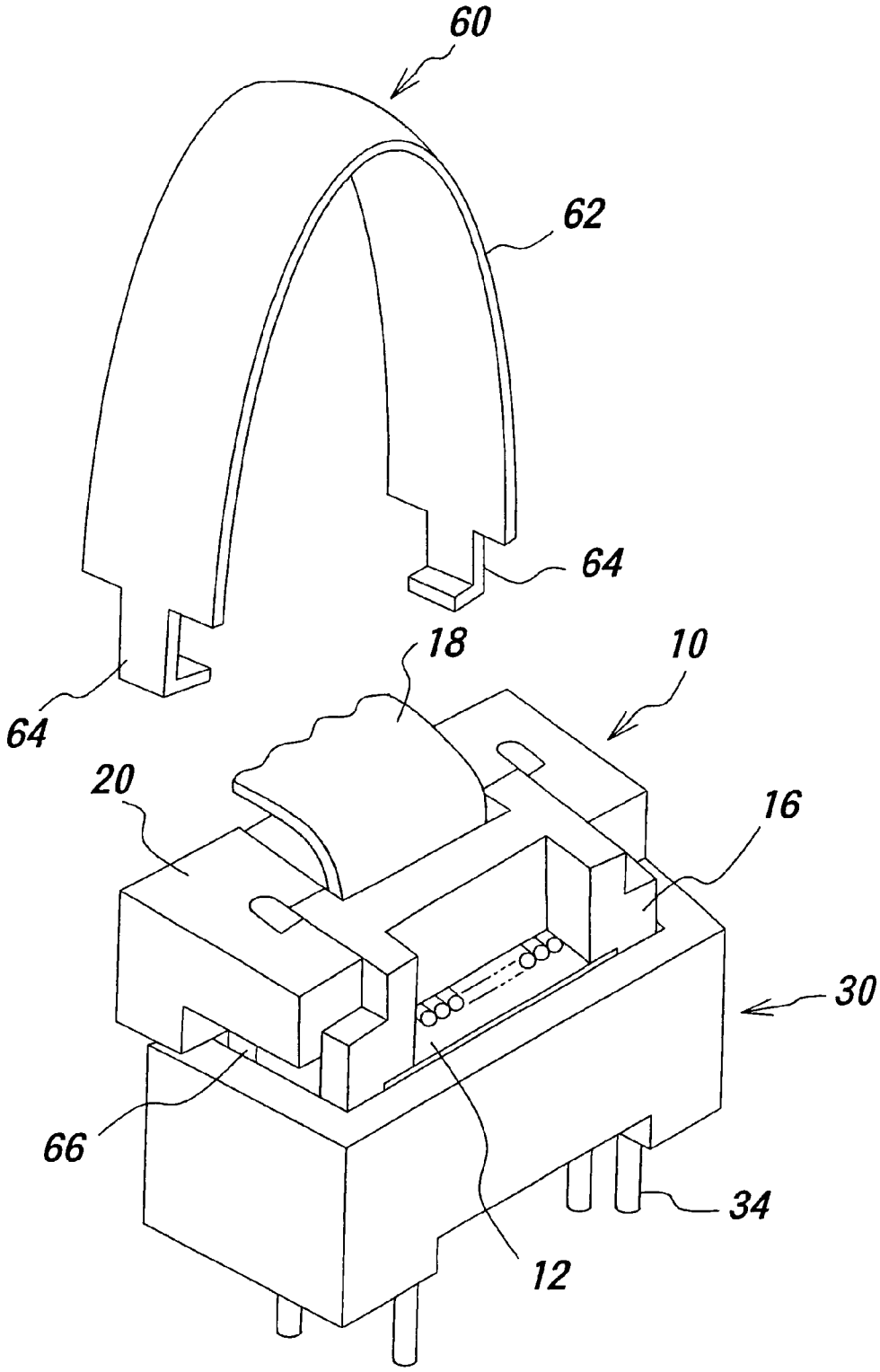
FIG. 3 is a perspective view of the pin connector and cable connector fitted with each other and a removing jig according to the invention.
Figure 4:
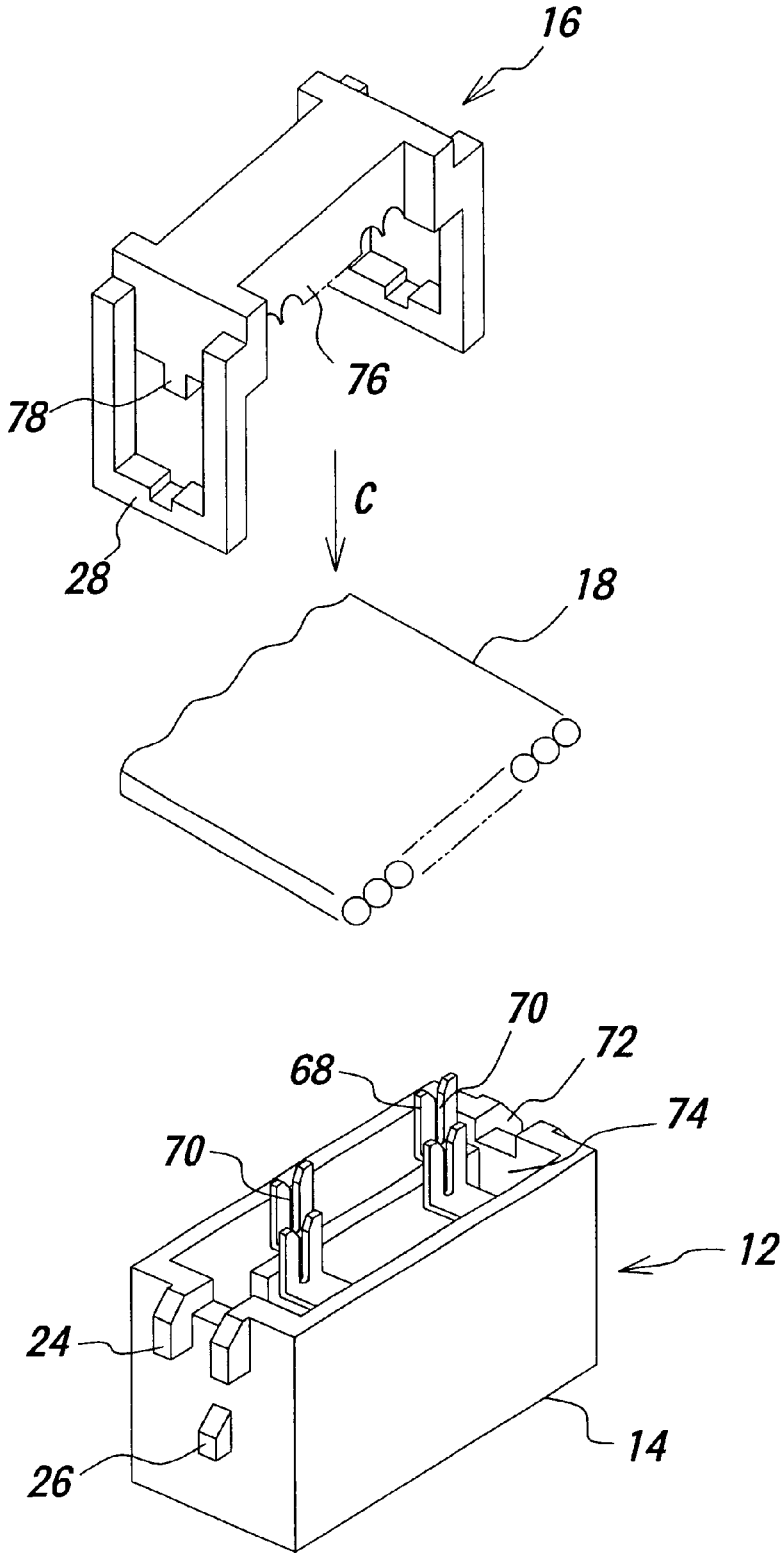
FIG. 4 is a perspective view of the cable, socket connector and the cover according to the invention.
Figure 5:
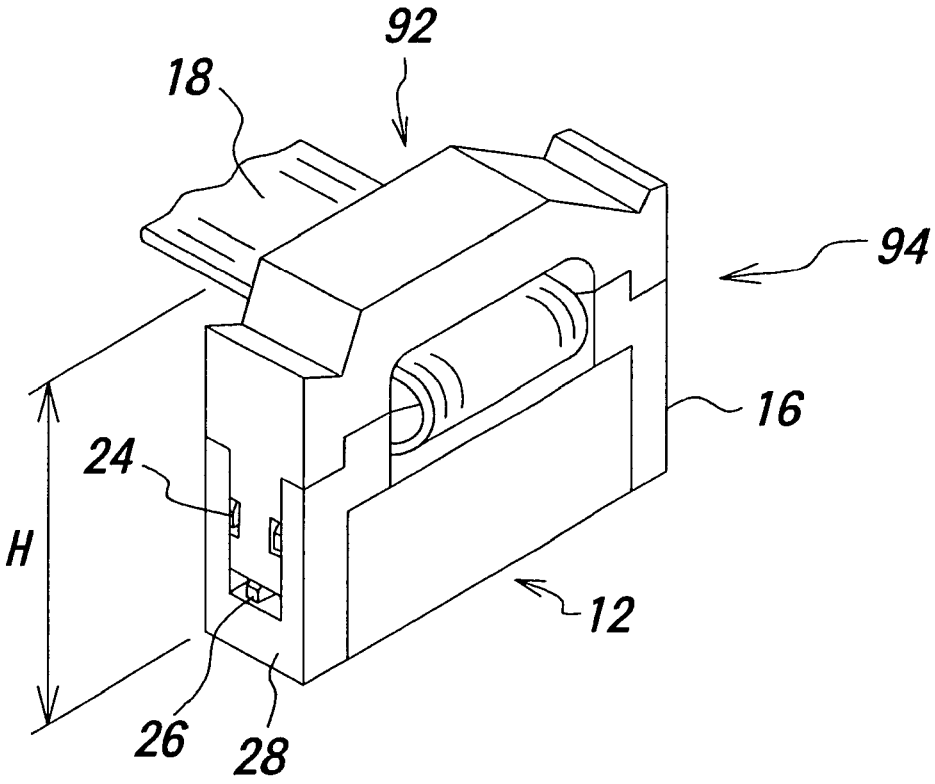
FIG. 5 PRIOR ART
FIG. 5 is a perspective view of a cable connector of the prior art.
Figure 6:
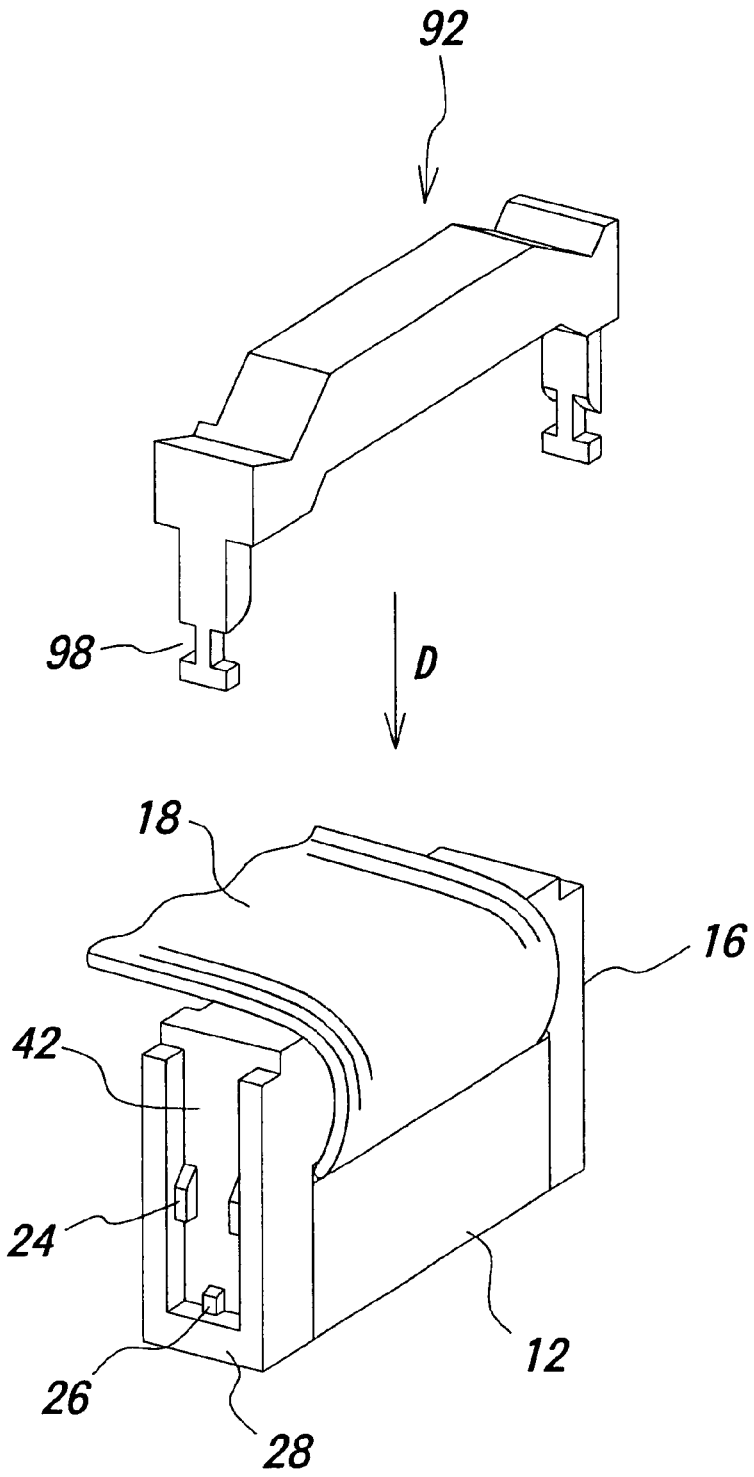
FIG. 6 PRIOR ART
FIG. 6 is a perspective view of a socket connector having a cable and a cover mounted thereon and a strain-relief of the prior art.

The socket connector 12 will then be explained. The socket connector 12 is composed of socket contacts 68 and the housing 14 (FIG. 4). The socket contacts 68 are fixed to the housing 14 by press-fitting, hooking or the like. The socket contacts 68 are made of a metal by means of the known press working or stamping. Preferred materials from which to form the socket contacts 68 include brass, phosphor bronze, beryllium bronze and the like which substantially comply with the imposed requirements for the workability, springiness and the like. The socket contact 68 consists of a contacting portion adapted to contact the pin contacts 34 (FIG. 3), a fixing portion fixed to the housing 14 and a connection portion to be connected to a conductor of the cable 18 and formed with a U-shaped slit 70 (FIG. 4). The conductor of the cable 18 is forced into the U-shaped slit 70 to accomplish an electrical connection therebetween.

The housing 14 is made of an insulating plastic material by the known injection molding. Preferred materials from which to form the housing 14 are required to be easy to work and inexpensive, and are polybutylene terephthalate (PBT), polyamide (PA), polycarbonate (PC) and the like. The housing 14 includes insertion recesses 74 which are formed independently for receiving the socket contacts 68, respectively. On each of the width ends of the housing 14 there are provided the two anchoring portions 24 extending outwardly from the upper end of the width end surface and the latch 26 substantially at the center of the width end surface. A recess 72 is formed between the two anchoring portions 24 at each width end surface.

The anchoring portions 24 are adapted to engage the engaging portions 54 of the strain-relief 20, and the latch 26 is adapted to engage a stopper 28 of the cover 16. The recesses 72 are adapted to be fitted with protrusions 78 of the cover 16 for positioning the cover 16 and the housing 14 relative to each other. The anchoring portions 24 and the latches 26 are so suitably designed that they are able to engage with the mating portions 54 and 28 to prevent the strain-relief from being dislodged even if the cable 18 is subject to a twisting force.

The cover 16 will be explained. The cover 16 serves to force the cable 18 against the socket connector 12 to accomplish the piercing connection or insulation displacement termination between the socket contacts 68 and the conductors of the cable 18. The cover 16 has a substantially U-shaped cross-section and is composed of an urging portion 76 and the engaging portions 28. Similarly to the housing 14, the cover 16 is made of an insulating plastic material by means of the known injection molding. The plastic materials such as polybutylene terephthalate (PBT), polyamide (PA), polycarbonate (PC) and the like are frequently used for forming the cover 16, which substantially fulfil the requirements for the workability and inexpensiveness.

As shown in FIG. 4, the urging portion 76 of the cover 16 has an urging surface commensurate with the cable 18 in a manner facilitating urging the cable 18 and preventing it from being damaged. The urging portion 76 is provided with the protrusions 78 substantially at the mid positions of its width ends, corresponding in position and size to the recesses 72 of the housing 14 for determining the relative positional relation between the cover 16 and the housing 14. Each of the engaging portions 28 is substantially in the form of a U-shape whose bottom engages the latch 26 of the housing 14 to fix the cover 16 to the housing 14. The engaging portions 28 may have any shape and size so long as they can engage the latches 26 of the housing 14 so that the engaging portions 28 are designed in consideration of strength, workability, the size of the connector and the like.

Finally, the method for assembling the cable connector 10 will be explained. First, the socket contacts 68 are held and fixed in the insertion portions 74 of the housing 14 by means of press-fitting. (This assembly consisting of the housing 14 and the socket contacts 68 is referred to as "socket connector 12".) Second, a cable 18 is set in position on the socket connector 12 and the cover 16 is then urged in the direction shown by an arrow C toward the socket connector 12 as by means of a jig (not shown) as shown in FIG. 4.

By urging the cover 16 toward the socket connector 12, the conductors of the cable 18 are brought into piercing connection to the socket contacts 68 at their U-shaped slits 70. Third, the strain-relief 20 is then mounted in the direction shown by an arrow B (FIG. 2) onto the thus assembled socket connector 12, the cable 18 and the cover 16, whereby the cable 18 is embraced between the strain-relief 20 and the cover 16. By carrying out the above first to third steps, the cable connector 10 shown in FIG. 1 is completed.

The pin connector 30 which is another unit of the electrical connector 1 will be explained herein. The pin connector 30 consists of pin contacts 34 and a block 32. The block 32 is made of an insulating plastic material by means of the known injection molding or the like. The plastic materials such as polybutylene terephthalate (PBT), polyamide (PA), polycarbonate (PC) and the like are frequently used for forming the block 30, which substantially fulfil the requirements for the workability and inexpensiveness. As shown in FIG. 1, the block 32 is formed with a fitting opening 40 into which the cable connector 10 is fitted. The fitting opening 40 is somewhat larger than the cable connector 10. The block 32 is further formed with insertion apertures into which pin contacts 34 are fixed as by press-fitting.

The pin contacts 34 are made of a metal as by the known press working or stamping. Preferred materials from which to form the pin contacts 34 include brass, phosphor bronze, beryllium bronze and the like which substantially fulfil the imposed requirements for the workability and springiness. Each of the pin contacts 34 consists of a contacting portion 36 adapted to contact a socket contact 68, a fixing portion to be fixed to the block 32 and a connection portion 38 to be connected to a board or the like.

The method for removing the cable connector 10 from the pin connector 30 will be explained by referring to FIG. 3. When the electrical connector 1 including the pin connector 30 fitted with the cable connector 10 is installed in a narrow space in an electric appliance, it is difficult to remove the cable connector 10 therefrom by fingers. In order to facilitate such a removing, between the strain-relief 20 of the cable connector 10 and the block 32 of the pin connector 30 are provided spaces or shoulders 66 into which lower ends of removing means 60 are inserted as shown in FIG. 3. In tile shown embodiment, the removing means 60 is in the form of a U-shaped jig formed by bending a metal plate whose curved portion 62 has at distal ends L-shaped engaging portions 64 adapted to engage in the spaces 66 between the strain-relief 20 and the block 32. The removing means 60 may have any shape so long as it can engage in the spaces 66 between the strain-relief 20 and the block 32 to remove the cable connector 10. The U-shaped removing means as in the shown embodiment is preferable because it is wieldy and resilient.

Figure 7:
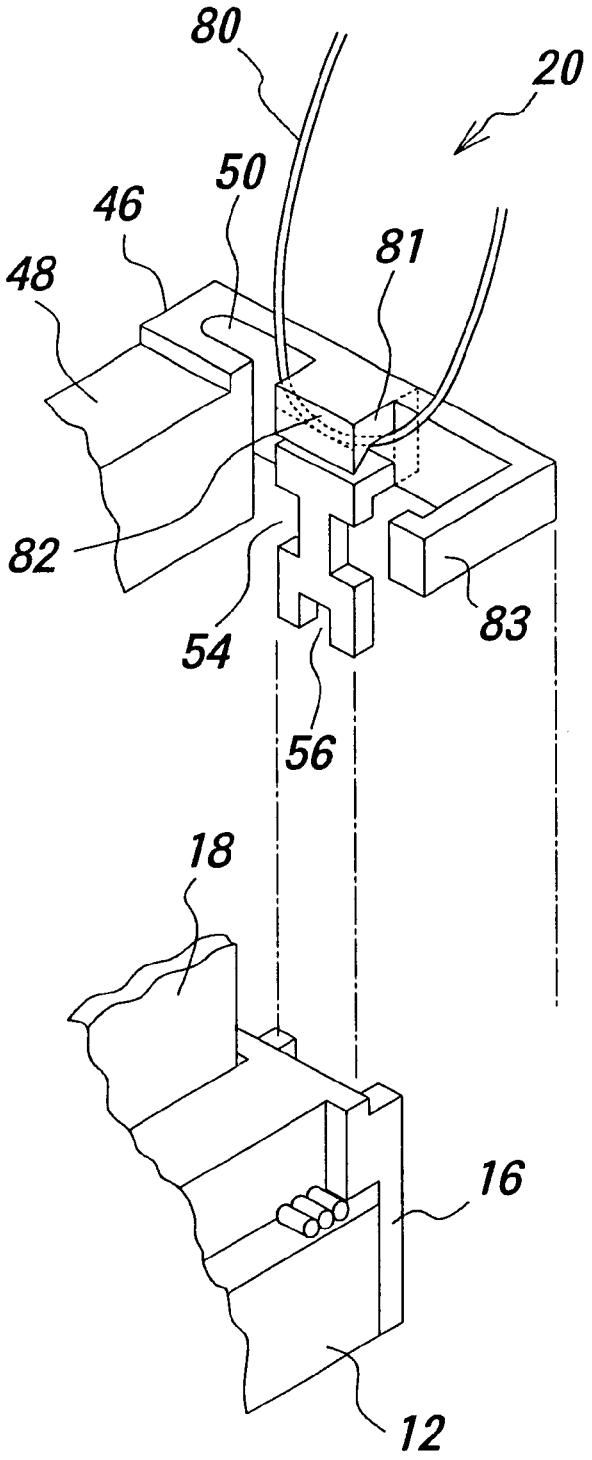
FIG. 7 is a perspective view of a removing string in the form of a loop engaging one side portion of a strain-relief according to the invention.

FIG. 7 illustrates alternative removing means using strings or cords 80 instead of the removing means 60. In this embodiment, each of the side portions 46 of the strain-relief 20 is provided with a projection 81 extending downwardly to form a protrusion 82 tapered downwardly, forming a space with a part of the side surface of the cover 16 for receiving the string or cord 80. Each of the side portions 46 of the strain-relief 20 is further provided at its free end with an L-shaped extension 83 which is adapted to engage a shoulder or recess (not shown) provided in the cover 16.

In removing the cable connector 10 from the pin connector 30, the strings 80 are inserted below the downwardly tapered protrusions 82 of both the side portions 46 of the strain-relief 20 and pulled upwardly to remove the cable connector 10 out of a narrow space of an electric appliance. With this arrangement, the strings 80 are readily inserted below the downwardly tapered protrusion 82 and are prevented from coming out of the protrusions 82 when the strings are pulled for removing the cable connector 10. Moreover, the engagement of the L-shaped extensions 83 of the side portions will prevent the strain-relief 20 from being deformed outwardly to prevent it from being removed away from the remaining parts of the cable connector.

Figure 8:
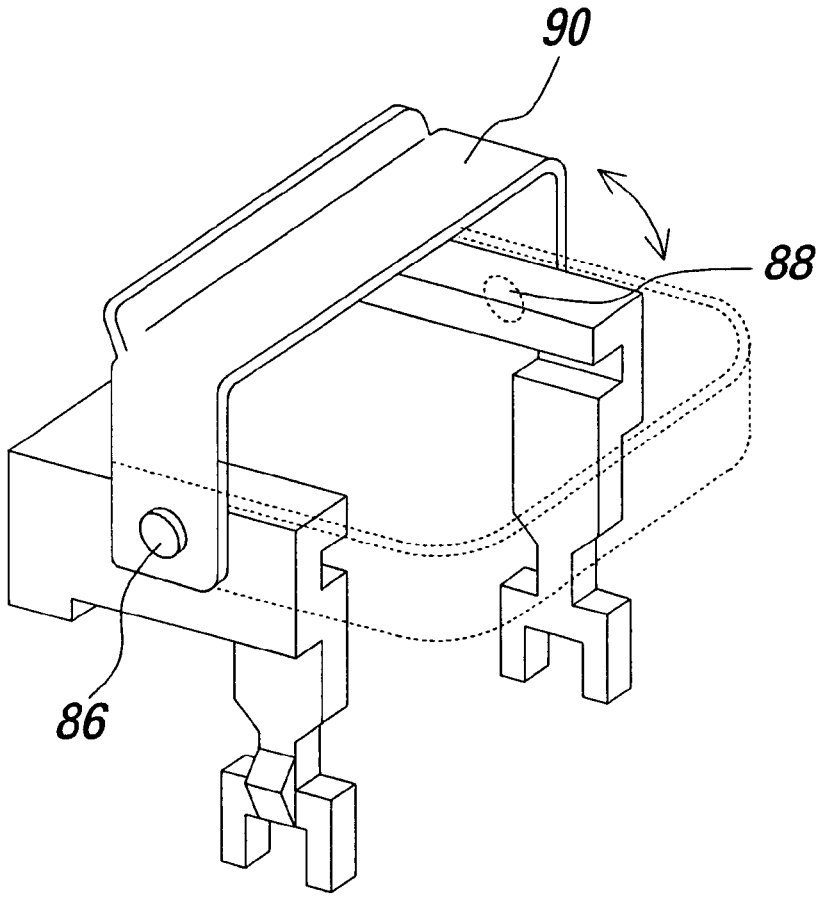
FIG. 8 is a perspective view of another embodiment of removing means as a removing lever pivotally connected to a strain-relief according to the invention.
Figure 9:
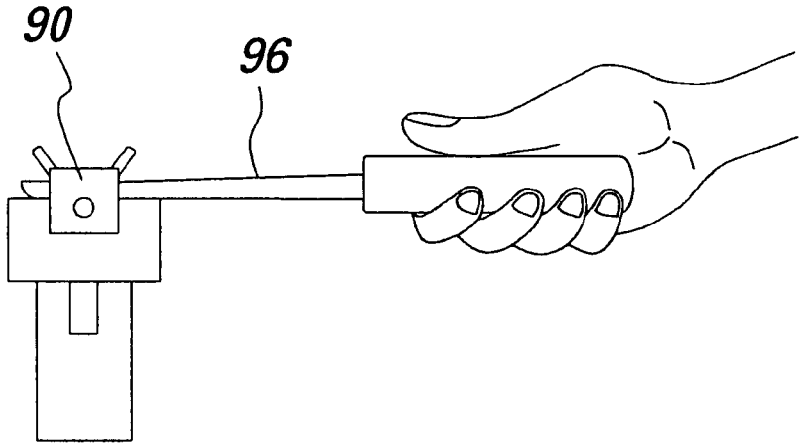
FIG. 9 is a perspective view of the removing lever shown in FIG. 8 pivoted into the vertical position into which a driver is inserted to remove the cable connector.

In another embodiment shown in FIG. 8, a U-shaped removing lever 90 pivotally connected to a strain-relief 20 at its both ends such that the removing lever 90 is pivotally moved about pins 86 and 88 between the positions shown in solid lines and imaginary lines. With this arrangement, it is effective to remove the cable connector 10 installed in an electric appliance which is narrow to an extent such that the removing means 60 or the string or cord 80 could not be used to remove the cable connector 10.

When the cable connector 10 is removed by the use of the U-shaped removing lever 90 shown in FIG. 8, the removing lever 90 is pivotally moved about the pins 86 and 88 from the inoperative position shown in imaginary lines to the operative position shown in solid lines as shown in FIG. 8 and a driver 96 is inserted with its distal end between the removing lever 90 and the strain-relief 20 to cause the strain-relief 20 to be raised. The removing lever 90 may be made of a rigid plastic or a metal plate which is able to withstand the repeated removing operation.

While the invention has been particularly shown and described with reference to preferred embodiment thereof, it will be understood by those skilled in the art that the foregoing and other changes in form and details can be made therein without departing from the spirit and scope of the invention.

What is claimed is:

1. An electrical connector including a pin connector and a cable connector detachably fitted with each other, said cable connector being composed of a cable, socket contacts to be connected to conductors of said cable, a housing for holding and fixing said socket contacts therein, a cover mounted onto said housing to cover it and urging said cable against said socket contacts, and a strain-relief mounted onto said housing to cover said cover and embracing said cable with said cover therebetween, and said pin connector being composed of pin contacts to be fitted with said socket contacts, and a block for holding and fixing said pin contacts therein, wherein said strain-relief consists of a main body and side portions located at both the ends of said main body, and wherein said main body of the strain-relief has an upper surface substantially lower than upper surfaces of said side portions by the thickness of said cable, and the upper surfaces of said side portions are substantially flush with the upper surface of said cover when the strain-relief has been mounted on said housing.

2. The electrical connector as set forth in claim 1, wherein each of said side portions of said strain-relief has a substantially L-shaped cross-section and is formed with a slit extending therethrough in its height direction in the proximity where the side portion is connected to the main body and is further formed with a groove extending therethrough away from said slit in the lengthwise direction of the side portion, thereby providing elasticity to the side portions of the strain-relief in horizontal and vertical directions.

3. The electrical connector as set forth in claim 1, wherein there are provided shoulders between said strain-relief of said cable connector and said block of said pin connector and there is provided removing means made of a plate piece by bending it into a U-shape, whose engaging portions are engageable with said shoulders, respectively, thereby enabling said cable connector to be removed.

4. The electrical connector as set forth in claim 1, wherein each of said side portions of said strain-relief is provided with a projection extending downwardly to form a protrusion tapered downwardly, forming a space with a part of the side surface of said cover for receiving a string for removing said cable connector, and wherein each of said side portions is provided at its free end with an L-shaped extension adapted to engage a shoulder provided on said cover.

5. The electrical connector as set forth in claim 1, wherein there is provided a removing lever pivotally connected to side surfaces of said strain-relief so as to be rotatable between substantially horizontal and vertical positions about pins provided on said side surfaces.

* * * * *

UNITED STATES PATENT AND TRADEMARK OFFICE

CERTIFICATE OF CORRECTION

PATENT NO. : 6,322,388 B1
DATED : November 27, 2001
INVENTOR(S) : Akio et al.

It is certified that error appears in the above-identified patent and that said Letters Patent is hereby corrected as shown below:

Title page,
Item [75], Inventor(s), "Yamada Akio" should read -- Akio Yamada --; "Kouda Takaharu" should read -- Takaharu Kouda --; and "Hayakawa Manabu" should read -- Manabu Hayakawa --

Column 1,
Line 28, "of" should read -- on --

Column 2,
Line 23, "to mount" should read -- mounting --
Line 49, "narrower" should read -- narrow --

Column 3,
Line 31, "is" should read -- are --
Line 44, "narrower" should read -- narrow --

Column 5,
Line 18, "more" should be deleted
Line 20, "then" should read -- now --

Column 7,
Line 6, "tile" should read -- the --

Signed and Sealed this

Nineteenth Day of November, 2002

*Attest:*

*Attesting Officer*

JAMES E. ROGAN
*Director of the United States Patent and Trademark Office*